US005246904A

United States Patent [19]

Hois et al.

[11] Patent Number: 5,246,904

[45] Date of Patent: Sep. 21, 1993

[54] CATALYST FOR THE WASH-AND-WEAR FINISHING OF TEXTILES

[75] Inventors: Pia Hois, Ludwigshafen; Toni Simenc, Mannheim, both of Fed. Rep. of Germany

[73] Assignee: BASF Aktiengesellschaft, Ludwigshafen, Fed. Rep. of Germany

[21] Appl. No.: 890,173

[22] Filed: May 29, 1992

[30] Foreign Application Priority Data

May 31, 1991 [DE] Fed. Rep. of Germany .... 4117902.1

[51] Int. Cl.[5] ..... B01J 21/02; B01J 21/10; B01J 27/12

[52] U.S. Cl. ..... 502/203

[58] Field of Search ..... 502/203

[56] References Cited

U.S. PATENT DOCUMENTS 3,807,952 4/1974 Lauchenauer ..... 8/186

FOREIGN PATENT DOCUMENTS 0359039 3/1990 European Pat. Off. .
3831093 3/1990 Fed. Rep. of Germany .
53-23893 3/1978 Japan ..... 502/203

OTHER PUBLICATIONS

World patents Index, File Supplier, Derwent Publications, Ltd., AN 75-38193W, & JP-A-49 093 700, Sep. 5, 1974.

*Primary Examiner*—W. J. Shine
*Attorney, Agent, or Firm*—Oblon, Spivak, McClelland, Maier & Neustadt

[57] ABSTRACT

A chloride-free catalyst for wash-and-wear finishing textiles with formaldehyde-free crosslinking agents contains magnesium and fluoroborate ions in a ratio of from 1:0.1 to 1:4 and guarantees odorless results.

3 Claims, No Drawings

CATALYST FOR THE WASH-AND-WEAR FINISHING OF TEXTILES

Owing to the persistent controversy about the use of formaldehyde-containing auxiliaries in the textile industry, there is an increasing trend, for example in the wash-and-wear finishing of textiles, toward using formaldehyde-free crosslinking agents, for example those of the formula I

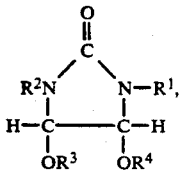

where $R^1$ and $R^2$ are each hydrogen or $C_1$–$C_3$-alkyl, with the proviso that at least one of the radicals $R^1$ and $R^2$ is $C_1$–$C_3$-alkyl, and $R^3$ and $R^4$ are each hydrogen or $C_1$–$C_4$-alkyl.

However, it is occasionally observed, in connection with large-scale production in textile processing operations, that the finished material is prone to give off an extremely unpleasant odor, which was not noticed when these crosslinking agents first came on the market. This odor is apparently the result of a catalytic decomposition of the crosslinking agent at elevated (condensation) temperatures, forming highly volatile compounds. The odor nuisance is particularly pronounced in the case of already made-up and airtightly packaged material.

It is an object of the present invention to find a way of avoiding this odor nuisance.

We have found that this object is achieved by a chloride-free catalyst whose use does not give rise to odor nuisance and which contains magnesium and fluoroborate ions in an $Mg^{2\oplus}$:$BF_4^{\ominus}$ molar weight ratio of from 1:0.1 to 1:4, preferably from 1:0.2 to 1:2.

Preferably, the catalyst is used in the form of an aqueous solution which contains from 15 to 40% by weight, preferably from 20 to 35%, of salt. The magnesium and fluoroborate ions may be introduced into such a solution in salt form, for example as magnesium sulfate, phosphate, nitrate, acetate, glycolate, citrate or adipate or as sodium, lithium, potassium or zinc fluoroborate. Particular preference is given to the use of magnesium sulfate, magnesium nitrate and sodium fluoroborate.

The catalyst is used in wash-and-wear finishing in the manner which is usual for example for magnesium chloride; the amounts used range from approximately 30 to 50 parts of a, for example, 20% solution, based on 100 parts of the crosslinking agent (45% solution). The novel catalyst requires no departure from existing methods. Experimental:

A cotton fabric (100 g/m$^2$) is impregnated with a pad-mangle, wet pickup about 80%, with the following solutions:

| | |
|---|---|
| Catalyst solution 1: | 8.7 parts of $MgSO_4$ *calcined*<br>2.0 parts of $NaBf_4$<br>29.3 $H_2O$ |
| Catalyst solution 2: | 8.7 parts of $MgSO_4$ calcined<br>2.5 parts of $Zn(BF_4)_2$<br>29.5 $H_2O$ |
| Catalyst solution 3: | 4.0 parts of $MgSO_4$ calcined<br>5.0 parts of $Mg(NO_3)_2.6H_2O$<br>0.5 parts of $NaBF_4$<br>20.5 $H_2O$. |

| | Operative Examples | | | | Comparative Examples | | | |
|---|---|---|---|---|---|---|---|---|
| | 1 | 2 | 3 | 4 | 5 | 6 | 7 | 8 untreated |
| Compound of formula I as 45% aqueous solution (parts) | 100 | 100 | 100 | 100 | 100 | 100 | 100 | |
| Catalyst solution 1 | 40 | | | | | | | |
| Catalyst solution 2 | | 40 | | | | | | |
| Catalyst solution 3 | | | 30 | | | | | |
| $MgCl_2 \times 6\ H_2O$ | | | | 12 | 10 | | | |
| $NaBF_4$ | | | | | 0.2 | | | |
| $Mg(BF_4)_2$ (30% solution in $H_2O$) | | | | | | 12 | | |
| $Zn(BF_4)_2$ (50% solution in $H_2O$) | | | | | | | 10 | |

The finished material was packed airtightly in polyethylene sheeting, stored for 24 hours and then subjected to an odor test.

The samples treated according to Examples 1 to 3 were odorless, those according to Examples 6 and 7 were slightly odorous, and those according to Examples 4 and 5 had an extremely unpleasant odor.

| | | Result of measurements: | | | | | | | |
|---|---|---|---|---|---|---|---|---|---|
| | | Operative Examples | | | | Comparative Examples | | | |
| | | 1 | 2 | 3 | 4 | 5 | 6 | 7 | 8 |
| Dry crease angle (W + F) | | 215° | 213° | 220° | 210° | 215° | 215° | 220° | 95° |
| Monsanto image after machine wash 20 min at 60° C. | | 3.0 | 3.0 | 3.5 | 3.0 | 3.0 | 3.2 | 3.5 | 1.0 |
| Breaking strength (filling) | | 290 | 285 | 280 | 285 | 275 | 290 | 295 | 390 |
| Shrinkage after machine wash 20 min | W: | 0.8 | 0.8 | 0.4 | 0.8 | 0.8 | 0.6 | 0.4 | 6.5 |
| | F: | 0.4 | 0.4 | 0.2 | 0.4 | 0.4 | 0.4 | 0.2 | 4.5 |

-continued

| | Result of measurements: | | | | | | | |
|---|---|---|---|---|---|---|---|---|
| | Operative Examples | | | | Comparative Examples | | | |
| | 1 | 2 | 3 | 4 | 5 | 6 | 7 | 8 |
| at 60° C. | | | | | | | | |

W = warp
F = filling

We claim:

1. A chloride-free catalyst for the wash-and-wear finishing of textiles with formaldehyde-free crosslinking agents, containing magnesium and fluoroborate ions in a molar weight ratio of from 1:0.1 to 1:4.

2. A catalyst as claimed in 1, containing $Mg^{2\oplus}$ and $BF_4\ominus$ ions in a ratio of from 1:0.2 to 1:2.

3. A catalyst as claimed in claim 1, in the form of a 20–35% by weight aqueous solution of magnesium and fluoroborate salts.

* * * * *